US005097872A

United States Patent [19]

Laine et al.

[11] Patent Number: 5,097,872

[45] Date of Patent: Mar. 24, 1992

[54] WOVEN WORK FABRIC WITH X-SHAPED MONOFILAMENT YARNS

[75] Inventors: Hannu Laine, Tampere; Ari Salminen, Kangasala, both of Finland

[73] Assignee: Tamfelt, Inc., Canton, Mass.

[21] Appl. No.: 628,088

[22] Filed: Dec. 17, 1990

[51] Int. Cl.[5] ..... D03D 15/00

[52] U.S. Cl. ..... 139/426 R; 57/248; 428/397; 428/229; 139/383 A

[58] Field of Search ..... 428/175, 229, 224, 397; 139/383 AA, 420 R, 420 A, 426 R, 383 A, 425 A; 57/244, 248

[56] References Cited

U.S. PATENT DOCUMENTS

| | | | |
|---|---|---|---|
| 3,158,984 | 12/1964 | Butler | 139/383 A |
| 3,716,138 | 2/1973 | Lumsden | 139/425 A X |
| 4,142,557 | 3/1979 | Kositzke . | |
| 4,290,209 | 9/1981 | Buchanan et al. . | |
| 4,634,625 | 1/1987 | Franklin | 139/426 R X |
| 4,705,601 | 11/1987 | Chiu | 139/383 A |
| 4,707,409 | 11/1987 | Phillips | 57/248 |

FOREIGN PATENT DOCUMENTS

| | | | |
|---|---|---|---|
| 252021 | 5/1966 | Austria . | |
| 0109657 | 6/1983 | Japan | 139/420 R |
| 1159020 | 7/1969 | United Kingdom . | |
| 1253070 | 11/1971 | United Kingdom . | |

*Primary Examiner*—Andrew M. Falik
*Attorney, Agent, or Firm*—Salter & Michaelson

[57] ABSTRACT

A woven work fabric includes a first set of monofilament yarns that extend in a first direction and a second set of monofilament yarns that are interwoven with the first set of yarns and that extend in a second direction that is transverse to the first set of yarns. Each of the monofilaments in one of the sets of yarns has a cross section that has a substantially "X"-shaped configuration, and that is deformed during the weaving of the yarn sets wherein a relatively flat outer exposed surface is formed on each of the monofilament yarns in the one set of yarns.

7 Claims, 1 Drawing Sheet

WOVEN WORK FABRIC WITH X-SHAPED MONOFILAMENT YARNS

BACKGROUND OF THE INVENTION

The present invention relates to a monofilament yarn as incorporated in cross-woven dryer fabrics for use as dryer fabrics, forming fabrics and press fabrics in paper making machines.

Dryer fabrics and the like as used in paper making machines are normally woven of polyester or other synthetic materials in a conventional shape or form. It is recognized in the art of weaving paper makers' dryer fabrics and other fabrics used in the paper making industry that the use of yarns having different cross sections can produce different results. Prior to the instant invention, many of the monofilament yarns as interwoven into dryer fabrics have been formed in a circular cross section. It is also recognized that certain monofilaments used in dryer fabrics and the like have been extruded in what is known as extruded flat warp weaving. In this latter technique, the warp yarns are formed of monofilaments with an essentially rectangular cross section, with the longer side parallel to and the shorter side perpendicular to the woven plane. These kinds of monofilaments are intended to produce a dryer fabric with a higher contact area and lower permeability than fabrics woven with yarns having a circular cross section. It is also known in the industry to use other cross sectional forms, such as oval yarns, in the weaving of paper makers' dryer fabrics.

Although the prior known weaving of paper makers' dryer fabrics produced fabrics that were acceptable for the most part for the purpose intended, the weaving of the monofilaments caused the cross sectional configuration thereof to be modified to some extent due to the forces that were created during the bending of the outer top edges of the monofilaments. As will be set forth hereinafter, the present invention relies on these forces that are created during weaving to produce an exceptionally smooth outer surface and improved stability over traditional yarn designs used in dryer fabrics.

SUMMARY OF THE INVENTION

The woven work fabric as embodied in the present invention comprises a first set of single monofilament yarns that extend in a machine direction and further includes a second set of single monofilament yarns that are interwoven with the first set of yarns and that extend in a cross machine direction that is transverse to the machine direction yarns. Each of the monofilaments in the first set of yarns has a cross section that has a substantially "X" configuration and that is deformed during the weaving of the yarn sets. Thus, the cross sectional configuration of the yarn is deformed in a manner that produces a smooth surface of the exposed outer areas of the woven monofilament yarns, while at the same time stability enhancing ridges are formed during weaving on the rear sides of the monofilament yarns. During the weaving process, the outer top edges of the machine direction yarns will tend to stretch, thereby creating a force that will bend the outer top edges downwardly to form the essentially flat outer surface, thereby producing an ideal surface for the dryer fabric in the paper making process.

Accordingly, it is an object of the present invention to form a woven work fabric that includes at least one set of monofilament yarns that have a cross section that has a substantially "X" configuration and that is deformed during the weaving of the yarn sets, wherein a relatively flat, outer exposed surface is formed on the monofilament yarns while the stability of the product is enhanced by corresponding ridges that are formed in the inside surface of the yarn.

Other objects, features and advantages of the invention shall become apparent as the description thereof proceeds when considered in connection with the accompanying illustrative drawings.

DESCRIPTION OF THE PREFERRED EMBODIMENT

Figure 1:
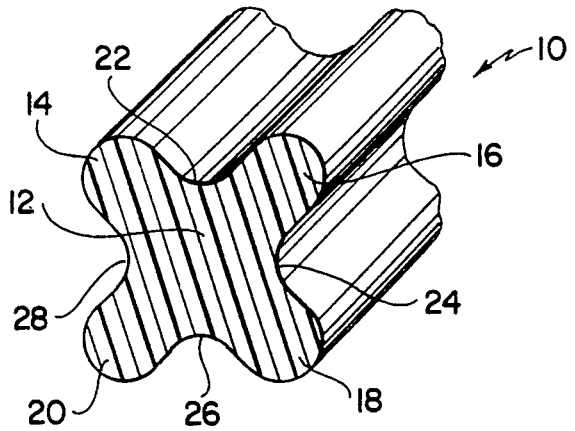
FIG. 1 is a cross sectional perspective view of a monofilament yarn as embodied in the subject invention.

Referring now to the drawing and particularly to FIG. 1, one form of the yarn or filament that is utilized in the subject invention to form a paper making fabric is illustrated and is generally indicated at 10. The yarn or filament 10 is preferably extruded as a monofilament of any suitable polymer, and is preferably formed of a polyester monofilament, particularly when used as a filament for woven dryer fabrics. The monofilament 10 is extruded in a unique configuration; and as illustrated in FIG. 1, is formed in substantially an X-shaped configuration. The monofilament 10 includes a body portion 12 from which legs 14, 16, 18, and 20 extend which have rounded outer edges. As will be described, the configuration of the monofilament 10 is such that when forces are applied to the monofilament during the weaving thereof, smooth outer surfaces are produced that promote the function required of a dryer fabric for carrying 18 paper material thereon. In addition, the configuration of the monofilament 10 improves the stability of the construction when it is combined with the cross yarns during the weaving process. The cross section of the monofilament 10 also creates a trough 22 between the legs 14 and 16, a trough 24 between the legs 16 and 18, a trough 26 between the legs 18 and 20, and a trough 28 that is formed between the legs 14 and 20.

Figure 3:
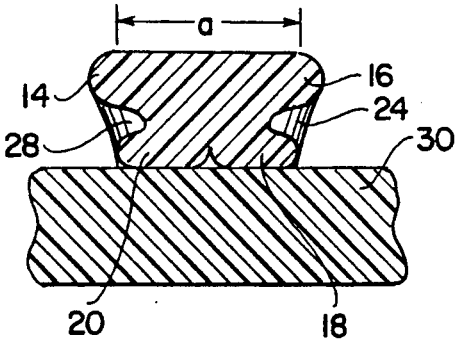
FIG. 3 is a sectional view taken along lines 3—3 in FIG. 2.

During the weaving process, the area defined by the trough 22 as formed between the legs 14 and 16 tends to stretch, thereby creating a force that bends the outer top edges of the loop 14 and 16 downwardly to flatten the trough 22 into an essentially flat outer surface indicated by the area "a" in FIG. 3. The troughs 24 and 28 essentially provide for the bending of legs 14 and 16 during the weaving process to enable the deformation of the monofilament to occur wherein the yarn profile is modified as indicated in FIG. 3.

Figure 2:
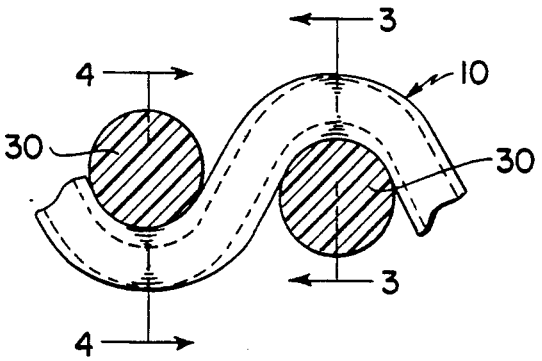
FIG. 2 is an elevational view of the monofilament yarn of the subject invention illustrating the weaving thereof with respect to cross yarns that are shown in cross section.
Figure 4:
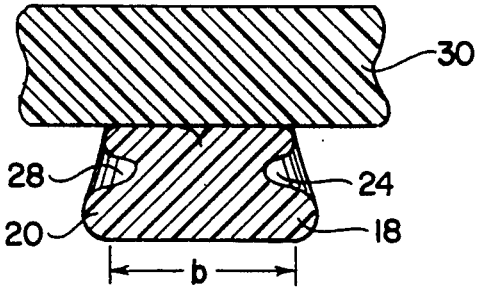
FIG. 4 is a sectional view taken along lines 4—4 in FIG. 2.

As the monofilaments 10 are interwoven with the cross yarns 30, the inner bottom edges also deform to form ridges for locking the filling or cross yarn in place, thereby adding stability to the woven structure. As seen in FIG. 3, the legs 18 and 20 of the monofilament 10 deform sufficiently to accommodate the cross yarns 30 thereagainst, the trough 26 being essentially closed as the legs 18 and 20 are deformed. The engagement of legs 18 and 20 with the cross yarn 30 defines the greatest point of pressure of the warp yarn 10 with the cross or weft yarn 30, whereby the warp and weft yarns essentially interlock to provide for positive stabilization of the fabric. As 18 further illustrated in FIG. 3, the troughs 24 and 28 provide sufficient space for the deformation of the legs 14 20 and 16 as they are bent downwardly due to the forces exerted by the weaving of the monofilament 10 with the yarns 30. When the monofilament 10 is bent around another filling yarn 30 as illustrated in FIG. 2, the forces exerted thereon are reversed, the former outer top edges now become the inner top edges as seen in FIG. 4, and the former inner bottom edges become the outer bottom edges as also seen in FIG. 4. Thus, the legs 18 and 20 are stretched to produce a flat outer surface indicated at "b" in FIG. 4. It is also understood that by increasing the vertical dimension of the troughs as seen in FIG. 1, the more stable the woven fabric produced will become. A trough area with a lower vertical dimension will produce a higher contact area and lower permeability will result when a plurality of the filaments 10 are combined with the cross yarns to produce the finished fabric.

It is also contemplated that the present invention may beutilized to regulate the air porosity of the fabric by employing a compaction process therewith. By utilizing a compaction roll treatment, the cross-woven fabrics would be more effective as compared to fabrics that utilize monofilaments formed with round, flattened or oval configuration in the woven array. The use of the present invention enables less than 100% of the warp-fill yarns to be utilized and still maintain the same air porosity that is obtained with the traditionally known filament profiles. The present invention also improves the contact area and stability of the dryer fabric, permitting a relatively wide range of air porosity regulation.

In all of the forms of the monofilament 10 as proposed, the dimensional characteristics will be such that the flat areas as produced by the bending of the legs to 22 form the top surface of the filament after weaving will be within conventional dimensional requirements for prior known yarns. For example, the diameter of a yarn having a circular cross section is generally about 0.5 mm. The largest cross-sectional longitudinal dimension of a filament having a rectangular cross section is usually about 0.8 mm. Thus, the dimensions of the filament 10 will be such as to come within the dimensional characteristics of the prior known filaments.

The present invention will generally improve the contact area because of the larger flat surface that is exposed following the weaving process, and it is also seen that the stability of the woven fabric as used as a dryer fabric is improved, thereby permitting a wider range for regulating air porosity. It is understood that the subject invention deviates from the prior known dryer fabric yarns by utilizing a monofilament that has a substantially "X"-shape configuration which enables the monofilament to be deformed during weaving, knitting, or during other subsequent processing, wherein the monofilament yarn 10 is disposed in a predetermined desired shape as used in the finished work fabric, thereby providing exposed surfaces that insure a superior result in the paper making process.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A woven work fabric, comprising a first set of single monofilament yarns that extend in a first direction and a second set of single monofilament yarns that are interwoven with said first set of yarns and that extend in a second direction that is transverse to said first set of yarns, at least one of said sets of single monofilament yarns having a cross section that has a substantially flattened "X"-shape configuration from being deformed during the weaving of the yarn sets, wherein a relatively flat outer exposed surface is formed on each of said monofilament yarns in said one set of yarns for interlocking the other set of yarns in place to stabilize said fabric.

2. A woven work fabric as claimed in claim 1, said "X"-shaped monofilament yarns having outer opposed legs, the top edges of which are stretched during weaving thereby creating a force which bends the outer opposed legs downwardly to form said relatively flat outer exposed surface.

3. A woven work fabric as claimed in claim 2, said "X"-shaped monofilament yarns extending in a longitudinal direction in the woven work fabric.

4. A woven work fabric as claimed in claim 3, the other set of monofilament yarns defining the weft or filling yarns in said woven work fabric.

5. A woven work fabric as claimed in claim 4, said monofilament weft yarns being deformable and having a substantially "X" -shaped cross sectional configuration.

6. A woven work fabric as claimed in claim 1, said "X"-shaped monofilament yarns having outer opposed legs, the top edges of which are stretched during weaving thereby 4 creating a force which bends the outer opposed legs downwardly to form a relatively flat outer exposed surface, each of said "X"-shaped monofilament yarns having inner opposed legs, the outer edges of which are compressed into interlocking engagement with said second set of monofilament yarns, thereby stabilizing said fabric.

7. A woven work fabric as claimed in claim 1, each of said "X"-shaped monofilament yarns having inner opposed legs, the outer edges of which are compressed into interlocking engagement with said second set of monofilament yarns thereby stabilizing said fabric.

* * * * *